United States Patent [19]

Owens

[11] 4,428,221

[45] Jan. 31, 1984

[54] TRANSFER APPARATUS FOR STRAIGHT SIDE PRESS

[76] Inventor: Roland G. Owens, 10850 Hall Rd., Box 145, Hamburg, Mich. 48139

[21] Appl. No.: 341,595

[22] Filed: Jan. 22, 1982

[51] Int. Cl.[3] ..... B21J 11/00

[52] U.S. Cl. ..... 72/405; 72/420; 72/422

[58] Field of Search ..... 72/405, 422, 419, 420, 72/344, 427

[56] References Cited

U.S. PATENT DOCUMENTS

| | | | |
|---|---|---|---|
| 3,011,464 | 12/1961 | Danly et al. | 72/405 |
| 3,411,340 | 11/1968 | Akira Asari | 72/427 |
| 3,998,087 | 12/1976 | Schumacher et al. | 72/405 |
| 4,033,237 | 1/1977 | O'Keefe | 72/405 |
| 4,003,237 | 4/1982 | Wallis | 72/344 |

*Primary Examiner*—Francis S. Husar
*Assistant Examiner*—David B. Jones
*Attorney, Agent, or Firm*—Culler, Sloman, Cantor, Grauer, Scott & Rutherford

[57] ABSTRACT

In a straight side press having a bed, a reciprocal slide, a power drive for the slide and apparatus for feeding a stock strip into the dies, the improvement of modifying the press to function as a transfer press by replacing the conventional die set with a plurality of longitudinally spaced sequential dies upon a die shoe secured to the bed to define a series of stations. A plurality of corresponding sequential punches are mounted upon a die shoe secured to the slide, and a pair of slide bars are reciprocally mounted upon the bed outwardly of the dies mounting pairs of opposed workpiece gripping fingers adapted for engagement with the respective workpieces at each station. A slide bar translator is mounted upon a sub-plate and has a reciprocal end plate connected to the slide bars for transferring the workpieces from station to station. The translator is adapted for alternately moving the slide bars towards and away from each other.

3 Claims, 5 Drawing Figures

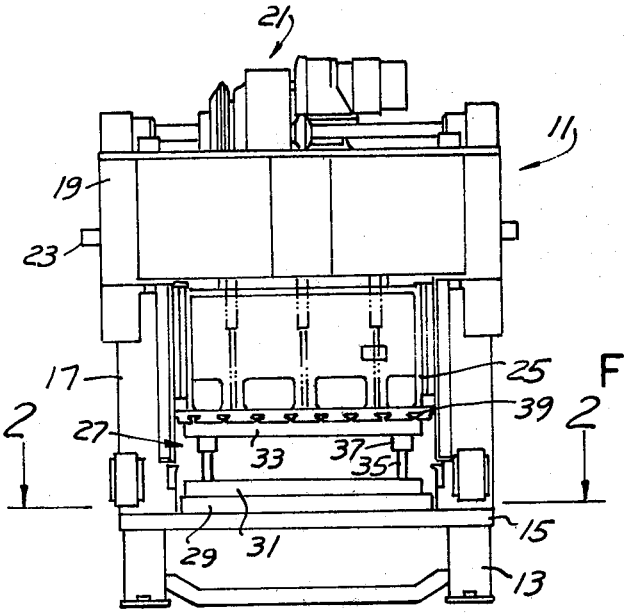
FIG. 1
FIG. 2
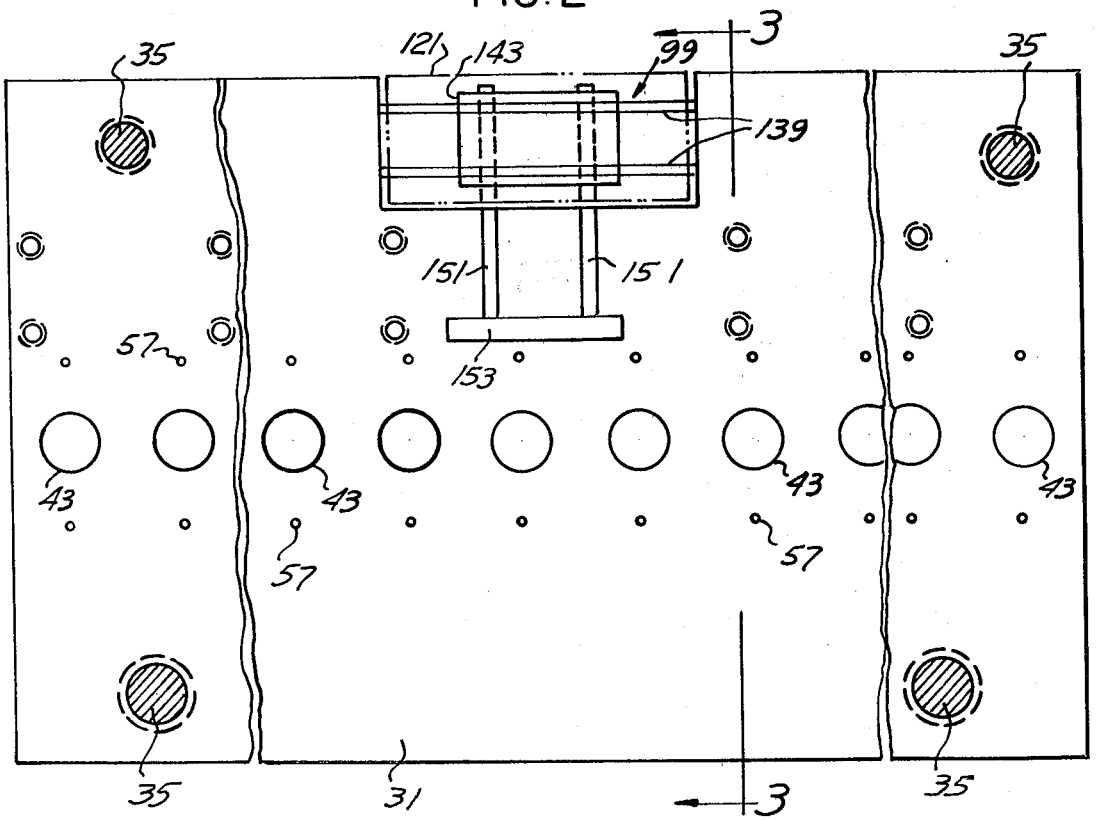

TRANSFER APPARATUS FOR STRAIGHT SIDE PRESS

BACKGROUND OF THE INVENTION

Heretofore in the conventional presses, there is normally employed a bed, a reciprocal slide, a power drive for the slide and an apparatus for feeding a stock strip into the die on the bed. Normally, the outer edges or some portion of the strip means in tact longitudinally and moves a part from station to station through final forming. A die set including a die or plurality of longitudinally spaced similar dies are mounted upon a lower die shoe secured to the bed. There is a corresponding punch for each die secured to the upper shoe and mounted to the reciprocal slide. Conventional means are provided for positioning the stock in the die and for removing the similarly formed articles. These presses are very expensive and can range $50,000 and $300,000.

Heretofore there has also been employed transfer presses which alone are similarly expensive and include a die set having a series of longitudinally spaced dies secured upon the lower die shoe and anchored to the bed, and a corresponding series of punches secured to the respective slide, together with a transfer mechanism built into the press intermittently moving the respective workpieces from one station to the next. This press cannot perform the motion and function used in conventional presses.

SUMMARY OF THE INVENTION

The object of the present invention is to be able to employ a conventional press for Progressive Dies with its conventional function which can be converted to a transfer press by substituting a transfer unit replacing the Progressive Die.

A transfer mechanism is part of the transfer unit which includes a pair of slide rails with grippers. The gripper fingers are arranged upon opposite sides of the row of individual dies together with a translator adapted for effecting reciprocal movements of the slide rails for transferring the workpieces from station to station successively. Alternatively and in some cases cams provide the function of moving the slide bars towards and away from each other. The gripping fingers are normally spaced from the workpieces until the time of transfer.

It is a further feature of the present invention to convert a straight side press by replacing the conventional die set assembly with a transfer unit assembly including a plurality of longitudinally spaced dies secured upon the lower die shoe to define a plurality of die stations; and attaching to the reciprocal upper die shoe a plurality of longitudinally spaced punches for operative registry with the dies respectively.

A further feature incorporates the use of a pair of elongated horizontal slide bars which are reciprocally mounted upon the lower die shoe arranged outwardly of the dies, with opposed pairs of a workpiece gripper fingers, pivotally mounted upon the slide bars in registry with each of the stations and adapted for engaging registry with the respective sequentially formed workpieces at each station.

A further feature incorporates the use of a slide bar translator mounted upon the manifold and secured to the slide bars for intermittently reciprocating the slide bars and fingers between adjacent stations for sequentially transferring the workpieces through all stations.

A further feature incorporates modified slide bars wherein there are employed stationery grippers normally spaced from the workpieces, and wherein the slide bar translator is adapted for the further function of moving the slide bars towards and away from each other for intermittently gripping the respective partially formed workpieces and successively transferring said workpieces simultaneously from one station to the next adjacent station, thereafter disengaging the slide bars and gripper fingers from the workpieces.

A further feature is to provide a slide bar translator which is itself available on the market and which can be utilized for effecting reciprocal or compound movements to the slide bars wherein the transfer unit converts a conventional press to a transfer press while maintaining the press for conventional use.

These and other features and objects will be seen from the following Specification and claims in conjunction with the appended drawings.

THE DRAWINGS

FIG. 1 is a fragmentary front elevational view of a straight side press for progressive die use.

FIG. 2 is a fragmentary plan view on an increased scale of the lower manifold and translator mounted thereon taken in the direction of arrows 2—2 of FIG. 1.

Figure 3:
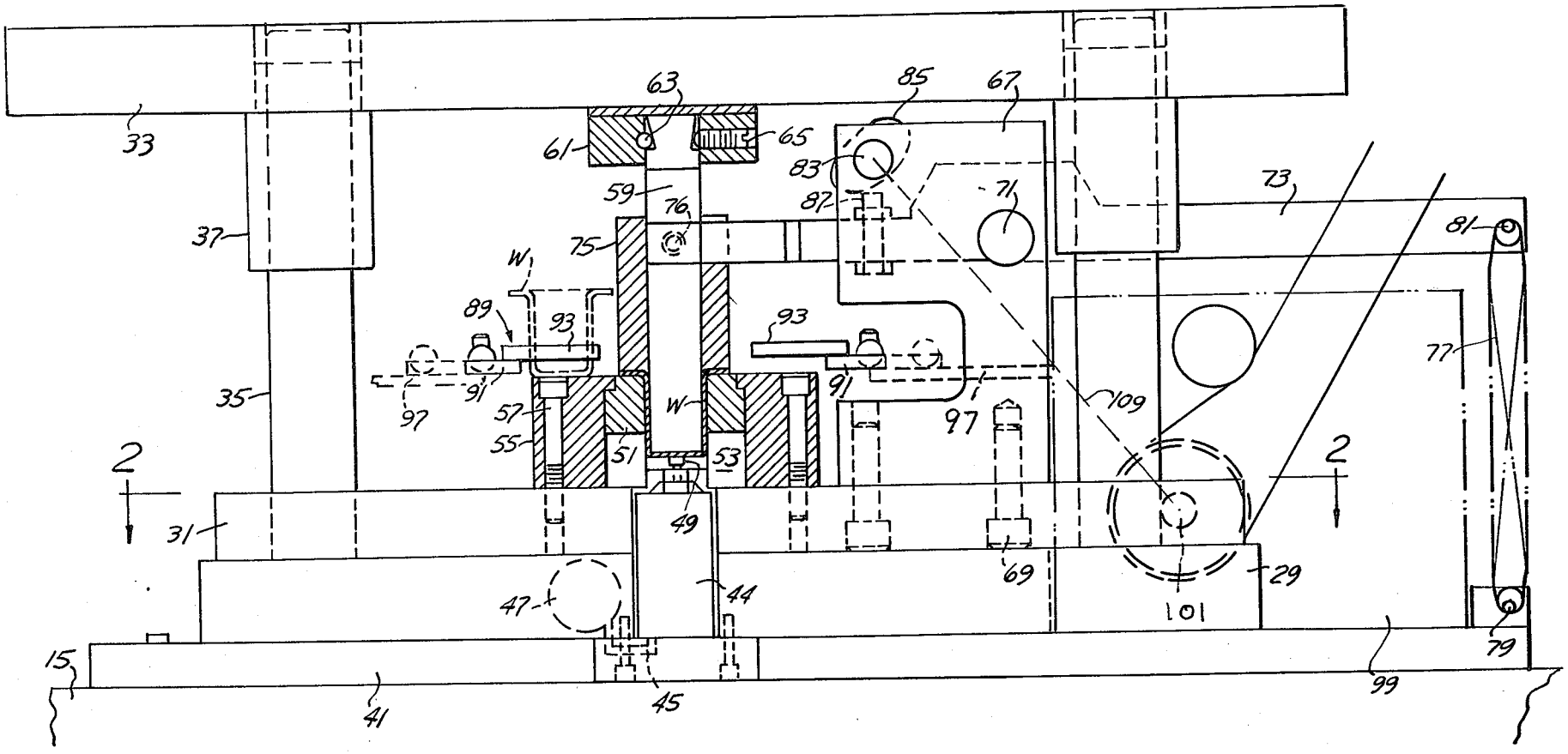
FIG. 3 is a fragmentary vertical section on an increased scale taken through the center of one of the stations in the direction of arrows 3—3 of FIG. 2.

It will be understood that the above drawings are illustrated merely preferred embodiments of the invention and that other embodiments are contemplated within the scope of the claims hereafter set forth.

DETAILED DESCRIPTION OF AN EMBODIMENT OF THE INVENTION

Referring to the drawings and particularly FIG. 1, a conventional straight side press 11 has a base 13, bed opposed upright sides 17, a crown 19 mounting a power drive assembly 21 and including the power rotated crank shaft 23 connected to the slide 25 guidably mounted upon the opposed sides 17 for intermittent reciprocal movements.

The straight side press in the illustrative embodiment normally using a conventional die set is converted to a transfer press by replacing such conventional die set with a die set 27, FIG. 1 including a series of longitudinally spaced dies 51 which are located at the stations 43, one of said dies being shown in section in FIG. 3. An elongated manifold 29 which is air or nitrogen pressurized, is mounted upon sub-plate 41 on bed 15 and suitably secured thereto. The lower die shoe 31 is mounted upon manifold 29 and is suitably secured thereto. Upper die shoe 33 is spaced directly above lower die shoe 31. A plurality of upright guide pins 35 are secured to the lower die shoe and guidably extend through a plurality of bushings 37 suitably secured, as by bolting to the underside of the upper die shoe 33 for guiding the reciprocal movements of the upper die shoe and for at all times maintaining the punches 59 in axial registry with the corresponding dies 51 at the respective stations 43.

The "T" slotted face 39 underlies the reciprocal slide 25 and is suitably secured to the upper die shoe 33 as shown in FIG. 1. A plurality of longitudinally spaced ejector cylinders 44 are arranged at each of the stations 43 and are in axial registry with the corresponding die 51, FIG. 3.

Conduits 45 in the mounting plate of each cylinder interconnect the respective cylinders with the interior of the manifold 29 for pressurizing each cylinder. The manifold 29 is connected to an exterior source of pressurized nitrogen or air pressure such as shown schematically at 47.

Each of the ejector cylinders includes a conventional ejector pin 49 in axial registry with die 51. Each die is mounted upon a suitable spacer 53 upon lower die shoe 31 and secured thereon by a die retainer 55 anchored to die shoe 31 by a series of fasteners 57. For each of the series of longitudinally spaced dies 51 mounted at the respective stations 43, FIG. 2, there is provided a die retainer 55 for anchoring the respective die to the lower die shoe. By this construction, the dies 51 are removably mounted upon the lower die shoe and can be individually removed and replaced as desired without the effecting the mounting and anchoring of the other dies in the set.

The corresponding plurality of longitudinally spaced punches 59 are in axial cooperative registry with the respective dies 51, and at their upper ends are each anchored within a punch holder 61 by the ball lock 63 or set screw 65, FIG. 3. The respective punch holders are secured to and underlie upper die shoe 33.

As is conventional in presses of this nature, there is provided a pair of longitudinally spaced stripper arm support blocks 67 mounted upon the lower die shoe 31 and secured thereto by fasteners 69. Support shaft 71 for the stripper arms extends between and is mounted upon the support blocks 67 and is suitably secured thereto.

A series of transversely spaced parallel stripper arms 73 correspondingly to the respective stations 43, intermediate their ends are mounted upon shaft 71. Conventional cylindrical strippers 75 axially receive the respective punches 59, and are flexibly secured as at 76 to the inner ends of the corresponding stripper arms 67.

The outer ends of the respective stripper arms are normally biased in a clockwise direction by the lift springs 77, anchored at 79 to the sub-plate 41 and at 81 to the outer ends of the corresponding stripper arm 73.

Transverse power rotated cam shaft 83 spans the respective support blocks 67, and mounts a plurality of stripper release cams 85 in registry with each of the stripper arms, adapted to operatively engage the adjusting screw 87 on each of the respective stripper arms. This is for intermittently rotating the stripper arms in a counterclockwise direction for the stripping function. This separates the workpiece W, which is formed or partially formed at a particular station, from the punch after the punch has been elevated by the upper die shoe so as to clear the finished workpiece and in the dash line displaced position shown in FIG. 3.

With the manifold 29 pressurized at all times, the respective ejector pins 49 are at all times biased upwardly so that upon withdrawal of the corresponding punch 59, a partly formed workpiece, as the case may be at a particular station, is ejected from the die 51.

Figure 4:
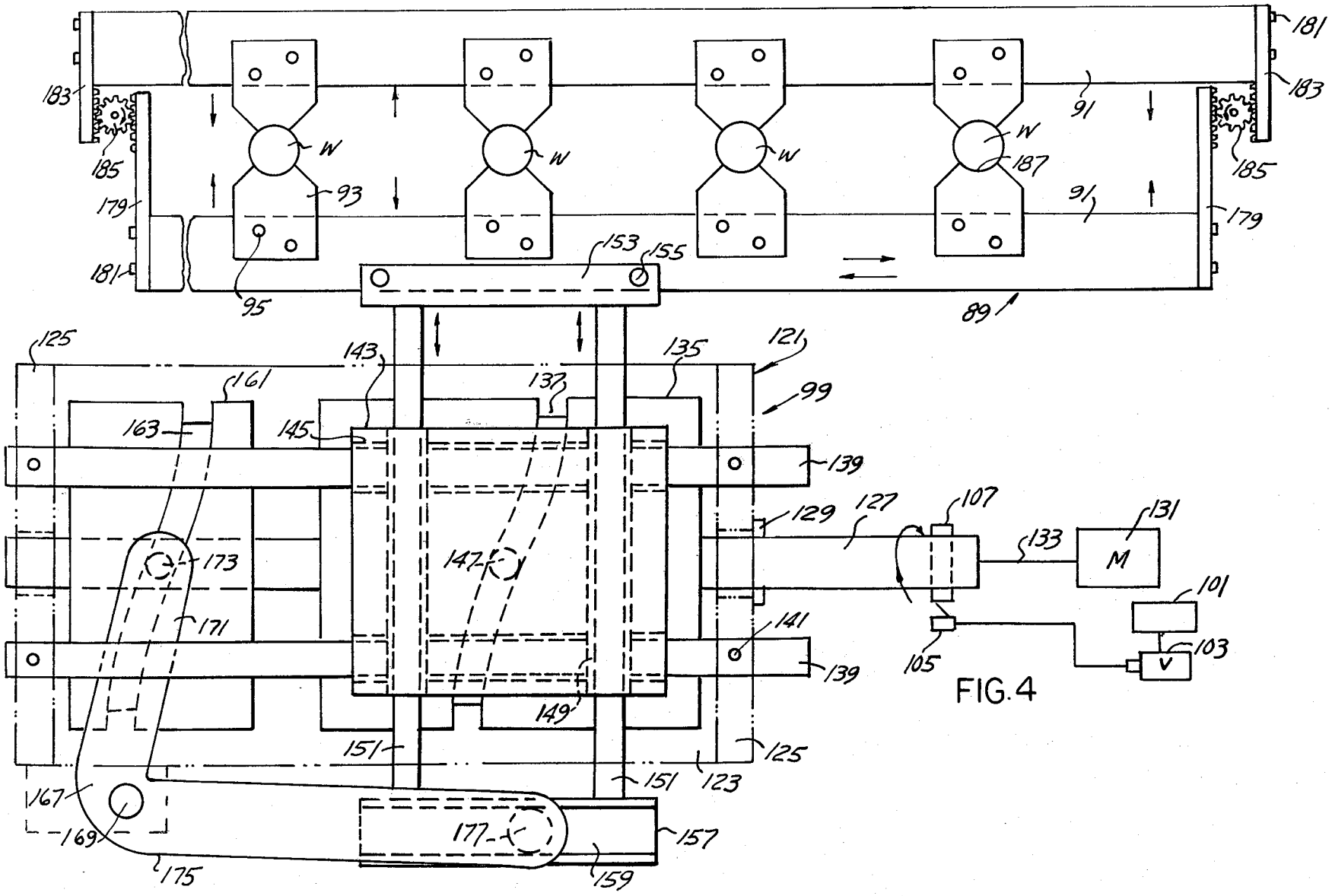
FIG. 4 is a fragmentary plan view of the pair of horizontal slide bars reciprocally mounted upon opposite sides of sequential dies and connected to a translator adapted for effecting in and out movements and successive alternate longitudinal reciprocal movements of the slide bars.
Figure 5:
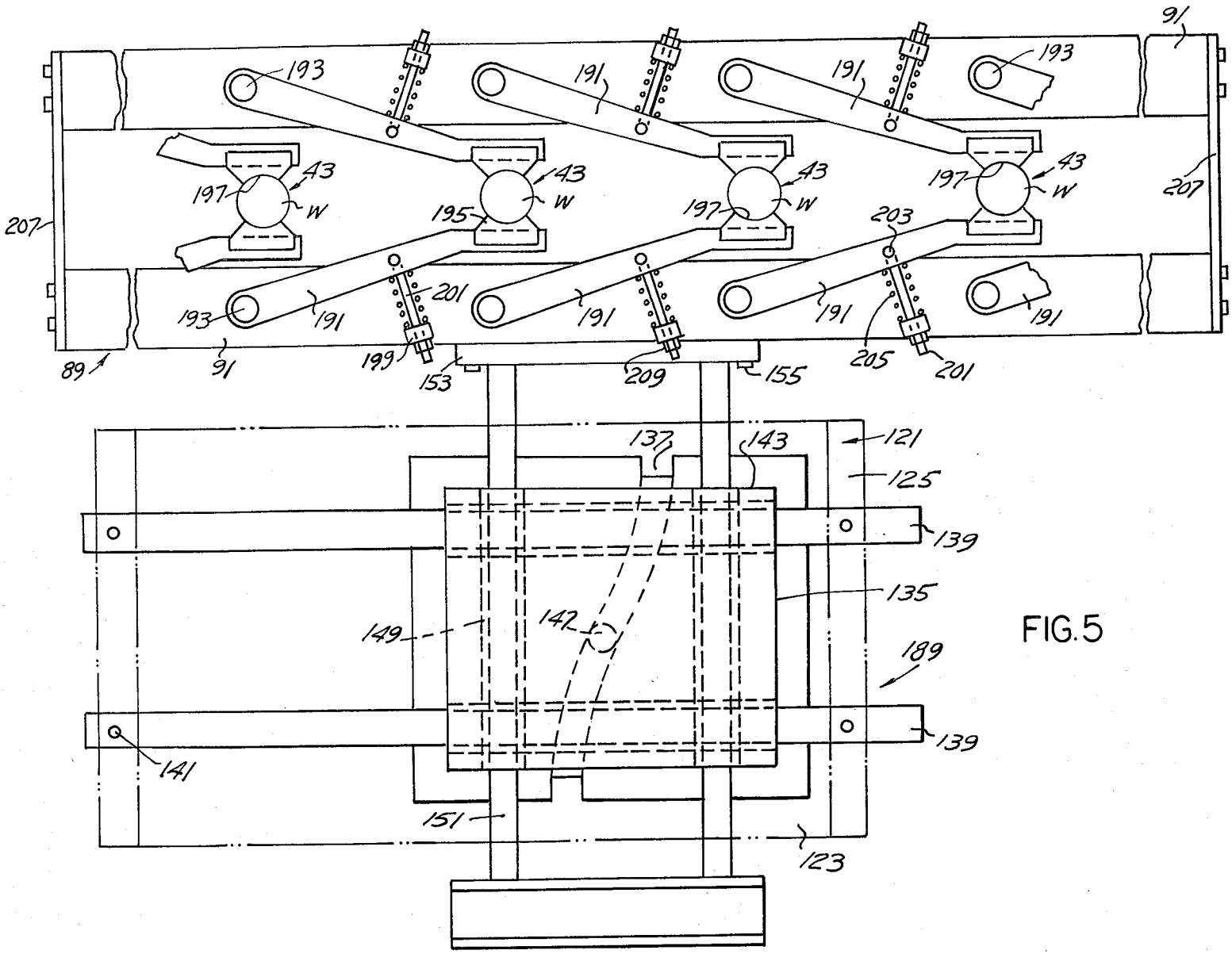
FIG. 5 is a view of a translator similar to FIG. 4, the translator being limited to longitudinal reciprocal movements of the slide bars.

In order to further modify the conventional straight side press so as to function as a transfer press, there is provided a transfer assembly 89, FIGS. 3, 4 and 5 for the sequentially formed workpieces W, for the primary function of transferring the workpiece from one station to the next station of a series of longitudinally spaced stations, such as designated schematically at 43, FIG. 2.

For this purpose there is provided a pair of walking beams or slide bars 91, FIG. 4 which are reciprocally and slidably mounted upon the lower die retainer such as upon slide bar support 97 which extends longitudinally of the upper die shoe. Said slide bars are arranged upon opposite sides of the series of stations 43 outwardly of the respective series of longitudinally spaced dies 51.

Slide bars 91, are adapted to move sequentially in a rectangular path under the control of the translator 99 mounted upon the subplate 41 schematically shown in FIG. 3, and on an enlarged scale in FIG. 4.

Mounted upon the opposed slide bars 91 corresponding to each of the stations 43, there are opposed longitudinal spaced pairs of workpiece gripper fingers 93 secured to the slide bars by fasteners 95. The respective fingers are normally arranged outwardly of the corresponding workpieces W at their respective stations, and in the position of the slide bars 91, FIG. 4 having been moved towards each other to operatively engage the respective workpieces. Thus, after the stations operations and retraction of the punches with the partially formed workpieces stripped from the punches, they are automatically transferred longitudinally to the next adjacent station 43.

The present slide bar translator is a product that is available on the market, is manufactured by a Stelron Cam Company, Saddlebrook, N.J.

In connection with the operation of the stripper arms 73, FIG. 3, there is an air or hydraulic cylinder 101 with control valve 103, actuated through a switch 105, operated by a cam 107 on shaft 127, FIG. 4. Cylinder 101 through a suitable linkage 109, FIG. 3 rotates shaft 83 mounting cam 85, which is timed to raise the stripper arm above the part just before transfer.

The present translator 99 is employed for effecting a predetermined longitudinal feed and in some cases corresponding in and out movements of the slide bars. Said translator includes a housing 121, FIGS. 4 and 5, base 123 on sub-plate 41 and a pair of upright end plates 125. Power driven shaft 127 extends through said end plates and is journaled through corresponding bearings 129 in said end plates and is coupled as at 133 to the motor 131, or power-source schematically shown in FIG. 4.

A first barrel cam 135 having a predetermined first cam groove 137 is positioned within said housing and secured to power driven shaft 137 for rotation therewith. A pair of longitudinally spaced parallel guide rods 139 span the respective end plates 125 and are secured thereto as at 141.

Longitudinally reciprocal slide 143 includes longitudinal bushings 145 slidably mounted upon the guide rods 139. Feed pin 147 depends from slide 143 and is guidably positioned within first cam groove 137 for effecting longitudinal reciprocal movements of slide 143 on rotation of cam 135.

A pair of parallel spaced transverse bushings 149 extend through slide 143, above the guide rods 139 and receive the pair of transverse feed rods 151 which slidably extends therethrough. End plate 153 spans the inner ends of the feed rods 151 and is suitably secured thereto. End plate 153 overlies the adjacent slide bar 91 and is secured thereto by fasteners 155. Accordingly, intermittent reciprocal longitudinal movements of slide 143 will effect corresponding reciprocal longitudinal movements of the slide bars 91. The opposite ends of the transverse feed rods 151 are interconnected by the in-feed block 157 which has upon its undersurface the elongated longitudinal slot 159.

A second barrel cam 161 having a second preformed cam groove 163 therein is positioned within said housing and secured upon driven shaft 127, spaced from the first barrel cam 135. Cantilever 167 intermediate its ends is supportably journaled at 169 upon an axis which is at right angles to driven shaft 127. Said cantilever includes an inner arm 171 which at one end mounts cam pin 173 which extends from said arm and into the second cam groove 163 of the second barrel cam 161.

The other arm 175 mounts at its outer end feed pin follower 177 which is movably positioned within the elongated slot 159 of in feed block 157. Accordingly, continuous rotary movements of the second barrel cam 161 are adapted to effect a predetermined rocking movement of the cantilever 167 with the cam groove 163 formed with such sufficient dwell construction that at the correct timing, there will be an initial inward feed movement of block 157 and connected transverse feed rods 151 and the attached end plate 153 connected to one of the slide bars 91.

The slide bars 91 are mounted and constructed in such a fashion that in this illustration, inward feed movement of the slide bar 91 adjacent end plate 153 will cause a corresponding simultaneous inward movement of the other slide bar 91. For this purpose there is provided upon the corresponding opposite ends of the slide bars 91 spaced rack gears 179 and 183 secured at 181. Pinions 185 are in mesh with the opposed rack gears 179 and 183.

Inward movements of end plate 153 will effect simultaneous inward movements of the respective slide bars 91 until the corresponding opposed workpiece gripper fingers 93 operatively engage the corresponding sequentially formed workpieces W. This in and out feed movement is controlled by the second barrel cam 161 with its corresponding preformed cam groove 163. In FIG. 4 groove 137 is shown 180° out of phase with respect to cam groove 163, for clarity.

Once the workpieces have been operatively engaged by the workpiece gripping fingers 93, the slide 143 controlled by cam 135 will be fed longitudinally to the right of FIG. 4 and which corresponds to the left for FIG. 2, for transferring the respective workpieces to the next adjacent station. At that point, the second barrel cam 161 will further function successively to retract the workpiece gripping fingers 93 to disengage the workpieces. Thereafter, the first barrel cam 135 will further function to return the slide bars simultaneously in the opposite direction back to the initial position. The transfer assembly is ready to again engage the workpieces after each forming stroke of the press until each of the workpieces have been sequentially transferred through all stations.

Modified slide bar translator 189 in FIG. 5 is constructed for effecting only reciprocal movements of the corresponding slide bars 91. Accordingly, the second barrel cam 161, shown in FIG. 4 for effecting in and out movements, is not in use or shown in FIG. 5.

In this case there are pivotally mounted at 193 upon each of the slide bars 91 opposed pairs of workpiece gripping fingers 191 having arcuate grips 195 at their inner ends normally in registry with each of the respective longitudinally spaced stations 43. Said fingers are in a plane corresponding to the vertical elevated ejected, schematically displaced, workpiece shown in dash lines in FIG. 3. This is a displaced position. Normally the workpiece when separated from a lower die is in a position of axial registry with the lower die directly above the workpiece W shown in FIG. 3. Primarily, the illustration of the workpiece in dash lines in FIG. 3 is merely to shown the vertical height of the workpiece as it is engaged by the workpiece grips 195 on the fingers 191.

Each of the grips include an arcuate groove 197. A series of opposed spaced angular blocks 199 are mounted upon each of the slide bars 91. These slidably support guide pins 201 which at their outer ends are pivotally connected as at 203 to the corresponding fingers 191 and at their opposite ends extend through the respective blocks. The nuts 209 upon the respective guide pins are for adjustment. A coil spring 205 is mounted upon each guide pin and is interposed between block 199 and the corresponding finger 191. The nut 209 provides a means of regulating the compression of the springs 205 normally biasing the workpiece engaging fingers 191 into retaining engagement with the corresponding workpieces W.

Since the slide bars are limited to longitudinal reciprocal movements, they are secured together and spaced by the transverse end slide bar connectors 207, FIG. 5.

In operaion, the respective workpiece gripper fingers 191 are biased into operative engagement with the respective workpieces W. Thus, fingers 191 are yieldable so that once the respective sequentially formed workpieces have been transferred to the next adjacent station and retained thereon in a conventional manner, the slide bars can return to their initial position merely by effecting a slight yielding retracting movement of the gripper finger disengaging them from the workpieces.

The present invention is primarily directed to apparatus for utilizing a conventional press so that by removal of the conventional die set, there can be substituted therefor a transfer unit applied to transfer work.

The apparatus includes feed mechanism in the form of walking beams or slide bars which are capable of longitudinal reciprocal movements needed in connection with the type of workpiece gripper fingers 191 shown in FIG. 5 or a compound movement transversely of the workpiece and longitudinally as shown by the translator contruction of FIG. 4.

The present invention also contemplates the method by which such straight side press can be used as a progressive die press, with standard material feeds remaining in place and converting to a transfer press by using the transfer unit.

Thus, what might be expected from a very expensive transfer press amounting from 50,000 to 300,000 dollars, can be accomplished by converting the present straight side press to a transfer press by using the transfer unit and retain all the functions of a progressive die press. It can be reconverted to the converted function of a straight side press.

It is contemplated in both cases, that the conventional press construction will provide suitable feed means by which the stock normally from a roll or strip is initially fed into the die set.

The stock normally would be moved to overlie the series of stations in a progressive die and then be separated from the strip of material. In the transfer unit the material required for the part is separated from the strip of material in the first station.

METHOD OF MODIFYING A STRAIGHT SIDE PRESS

The method would include replacing the conventional die set with a transfer unit including a plurality of longitudinally spaced sequential dies mounted upon the lower die shoe to define a series of stations. A further step includes the securing of the lower die shoe to the press bed.

Additional steps include:

Mounting a plurality of corresponding sequential punches upon an upper die shoe and securing the upper die shoe to the reciprocal slide.

Mounting a pair of slide bars upon the lower die shoe outwardly of a sequential dies.

Providing opposed pairs of workpiece gripper fingers upon the slide bars in registry with each of the stations.

Mounting a power operated translator upon the sub-plate, the translator having a longitudinally reciprocal slide mounting a side plate connected to the slide bars. A final step includes intermittently reciprocating the side plate and secured slide bars for intermittently and successively transferring the workpieces from station to station.

The foregoing method may include the further step of intermittently feeding the side plate upon the slide transversely of its feed movements for simultaneously moving the slide bars successively towards and away from each other for moving the workpiece fingers into and out of engagement with the workpieces. The inward movement of the side plate is alternated with intermittent longitudinal movements of the slide after which the slide bars are retracted to disengage the workpiece fingers from the respective workpieces.

The present tool is used to manufacture metal parts from flat stock fed from a coil, blanks and preforms. The purpose of the present unit is to utilize a conventional straight side press to perform the operations necessary in transfer work and on removing the transfer unit to utilize the conventional straight side press to perform the operations of coventionally progressive dies of other press operations.

It is contemplated that the present transfer mechanism may be applied to equivalent presses such as hydraulic presses, open back presses and gap frame presses.

Having described my invention, reference should now be had to the following claims:

I claim:

1. In a straight side press having sub-plate, a bed for mounting a die, a reciprocal slide, a power drive for reciprocating said slide, and an apparatus for feeding a stock strip longitudinally onto said die;

the improvement comprising a die set assembly including a lower die shoe assembly secured to said bed along its length;

a plurality of longitudinally spaced sequential dies secured upon said die shoe assembly defining a plurality of die stations;

reciprocal upper die shoe connected to said slide overlying and guidably positioned upon said lower die shoe assembly mounting a plurality of longitudinally spaced corresponding sequential punches for operative registry with said dies respectively;

a pair of spaced elongated horizontal slide bars reciprocally mounted above said lower die shoe assembly and arranged along and outwardly of said dies;

opposed pairs of workpiece gripper fingers pivotally and yieldably mounted at their one ends upon said slides respectively and at their other ends in registry with each station and adapted for engaging registry with the respective sequentially formed workpieces at each work station;

a slide bar translator mounted upon said sub-plate and secured to said slide bars for intermittently reciprocating said slide bars and fingers between adjacent stations, for sequentially transferring said workpieces through all stations;

spring means on said slide bars operatively engaging and biasing said pairs of fingers into workpiece engaging position, whereby on forward movement of said slide bars, the respective workpieces are simultaneously transferred from one station to the adjacent station and retained;

said fingers disengaging from said workpieces on retraction of said slide bars;

said spring means including a block on each slide bar;

a guide pin at one end adjustably positioned through said block;

the other end of said pin being pivotally connected to a gripper finger;

and a spring on said pin interposed between said block and finger.

2. In a straight side press having a sub-plate, a bed for mounting a die, a reciprocal slide, a power drive for reciprocating said slide, and an apparatus for feeding a stock strip longitudinally onto said die;

the improvement comprising a die set assembly including a lower die shoe secured to said bed along its length;

a plurality of longitudinally spaced sequential dies secured upon said die shoe defining a plurality of die station;

a reciprocal upper die shoe connected to said slide overlying and guidably positioned upon said lower die shoe mounting a plurality of longitudinally spaced corresponding sequential punches for operative registry with said dies respectively;

a pair of spaced elongated horizontal slide bars reciprocally mounted above said lower die shoe and arranged along and outwardly of said dies;

a means interconnecting and for moving said slide bars transversely toward and away from each other;

opposed aligned pairs of workpiece gripper fingers at their one ends mounted upon and secured to said slide bars, and at their other ends in registry with each station and adapted upon inward movement of said slide bars for engaging registry with the respective sequentially formed workpiece at each station;

a slide bar translator mounted upon said sub-plate and secured to a slide bar for successively moving said slide bars together, for intermittently reciprocating said slide bars and fingers between adjacent stations, and for moving said slide bars outwardly of said dies, for sequentially transferring said workpieces through all stations;

the means interconnecting said slide bars including inwardly facing opposed pairs of rack gears on and at right angls to the corresponding ends of said slide bars;

and an idle pinion gear interconnecting adjacent rack gears.

3. In a straight side press having a sub-plate, a bed for mounting a die, a reciprocal slide, a power drive for reciprocating said slide, and an apparatus for feeding a stock strip longitudinally onto said die;

the improvement comprising a die set assembly including a lower die shoe secured to said bed along its length;

a plurality of longitudinally spaced sequentially dies secured upon said die shoe defining a plurality of die stations;

a reciprocal upper die shoe connected to said slide overlying and guidably positioned upon said lower die shoe mounting a plurality of longitudinally spaced corresponding sequential punches for operative registry with said dies respectively;

a pair of spaced elongated horizontal slide bars reciprocally mounted above said lower die shoe and arranged along and outwardly of said dies;

a means interconnecting and for moving said slide bars transversely toward and away from each other;

opposed aligned pairs of workpiece gripper fingers at their one ends mounted upon and secured to said slide bars, and at their other ends in registry with each station and adapted upon inward movement of said slide bars for engaging registry with the respective sequentially formed workpiece at each station;

a slide bar translator mounted upon said sub-plate and secured to a slide bar for successively moving said slide bars together, for intermittently reciprocating said slide bars and fingers between adjacent stations, and for moving said slide bars outwardly of said dies, for sequentially transferring said workpieces through all stations;

said slide bar translator including a housing;

a driven shaft journaled upon said housing longitudinally thereof and connected to a rotatable power drive;

a first barrel cam within said housing having a first cam groove secured upon said driven shaft;

a longitudinally reciprocal slide guidably mounted upon said housing including a feed pin guidably nested in said first cam groove;

an end plate spaced from said slide and slidably mounted thereon for transverse movements relative to said slide and secured to a slide bar;

a second barrel cam within said housing having a second cam groove secured upon said driven shaft;

a cantilever pivotally mounted upon said housing upon an axis at right angles to said driven shaft, upon one arm having a control pin guidably extending into said second cam groove, and upon its other arm a feed pin operatively engaging said end plate for effecting said reciprocal movements thereof transversely of said driven shaft;

the mounting of said slide including a pair of parallel spaced shafts mounted upon said housing, said slide movably mounted upon said shafts;

the mounting of said end plate including a second pair of parallel spaced shafts slidably mounted upon said slide transversely thereof;

said end plate being secured upon their one ends;

and a feed block interconnecting the other ends of said second pair of shafts having a longitudinal feed slot therein;

said cantilever feed pin operatively extending into said feed slot.

* * * * *